175-48
5/30/78 XR 4,091,881 SR

United States Patent [19]
Maus
[11] 4,091,881
[45] May 30, 1978

[54] ARTIFICIAL LIFT SYSTEM FOR MARINE DRILLING RISER

[75] Inventor: Leo Donald Maus, Houston, Tex.

[73] Assignee: Exxon Production Research Company, Houston, Tex.

[21] Appl. No.: 786,530

[22] Filed: Apr. 11, 1977

[51] Int. Cl.[2] ..... E21B 15/02
[52] U.S. Cl. ..... 175/7; 175/72; 175/25; 175/48
[58] Field of Search ..... 175/5, 7, 25, 38, 48, 175/50, 69, 72; 166/.5; 299/17; 417/54, 65, 86

[56] References Cited

U.S. PATENT DOCUMENTS

| | | | |
|---|---|---|---|
| 2,923,531 | 2/1960 | Bauer et al. | 166/.5 X |
| 3,603,409 | 9/1971 | Watkins | 175/25 |
| 3,809,170 | 5/1974 | Ilfrey | 175/48 X |
| 3,815,673 | 6/1974 | Bruce et al. | 166/.5 X |

*Primary Examiner*—Ernest R. Purser
*Assistant Examiner*—Richard E. Favreau
*Attorney, Agent, or Firm*—Salvatore J. Casamassima

[57] ABSTRACT

An improved offshore drilling method and apparatus are disclosed which are particularly useful in preventing formation fracture caused by excessive hydrostatic pressure of the drilling fluid in a drilling riser. One or more flow lines are used to withdraw drilling fluid from the upper portion of the riser pipe. Gas injected into the flow lines substantially reduces the density of the drilling fluid and provides the lift necessary to return the drilling fluid to the surface. The rate of gas injection and drilling fluid withdrawal can be controlled to maintain the hydrostatic pressure of the drilling fluid remaining in the riser and wellbore below the fracture pressure of the formation.

6 Claims, 4 Drawing Figures

ARTIFICIAL LIFT SYSTEM FOR MARINE DRILLING RISER

BACKGROUND OF THE INVENTION

1. Field of the Invention

This invention relates to an improved method and apparatus for drilling a well beneath a body of water. More particularly, the invention relates to a method and apparatus for maintaining a controlled hydrostatic pressure in a drilling riser.

2. Description of the Prior Art

In recent years the search for oil and natural gas has extended into deep waters overlying the continental shelves. In deep waters it is common practice to conduct drilling operations from floating vessels or from tall bottom-supported platforms. The floating vessel or platform is stationed over a wellsite and is equipped with a drill rig and associated equipment. To conduct drilling operations from a floating vessel or platform a large diameter riser pipe is employed which extends from the surface down to a subsea wellhead on the ocean floor. The drill string extends through the riser into blowout preventers positioned atop the wellhead. The riser pipe serves to guide the drill string and to provide a return conduit for circulating drilling fluids.

An important function performed by the drilling fluids is well control. The column of drilling fluid contained within the wellbore and the riser pipe exerts hydrostatic pressure on the subsurface formation which overcomes formation pressures and prevents the influx of formation fluids. However, if the column of drilling fluid exerts excessive hydrostatic pressure, the reverse problem can occur, i.e., the pressure of the fluid can exceed the natural fracture pressure of one or more of the formations. Should this occur, the hydrostatic pressure of the drilling fluid could initiate and propogate a fracture in the formation, resulting in fluid loss to the formation, a condition known as "lost circulation". Excessive fluid loss to one formation can result in loss of well control in other formations being drilled, thereby greatly increasing the risk of a blowout.

The problem of lost circulation is particularly troublesome in deep waters where the fracture pressure of shallow formations, especially weakly consolidated sedimentary formations, does not significantly exceed that of the overlying column of seawater. A column of drilling fluid, normally weighted by drill cuttings and various additives such as bentonite, need be only slightly more dense than seawater to exceed the fracture pressure of these formations. Therefore, to minimize the possibility of lost circulation caused by formation fracture while maintaining adequate well control, it is necessary to control the hydrostatic pressure within the riser pipe.

There have been various approaches to controlling the hydrostatic pressure of the returning drilling fluid. One approach is to reduce the drill cuttings content of the drilling fluid in order to decrease the density of the drilling fluid. That has been done by increasing drilling fluid circulation rates or decreasing drill bit penetration rates. Each of these techniques is subject to certain difficulties. Decreasing the penetration rate requires additional expensive rig time to complete the drilling operation. This is particularly a problem offshore where drilling costs are several times more expensive than onshore. Inceasing the circulation rate is also an undesirable approach since increased circulation requires additional pumping capacity and may lead to erosion of the wellbore.

Another approach in controlling hydrostatic pressure is to inject gas into the lower end of the riser. Gas injected into the riser intermingles with the returning drilling fluid and reduces the density of the fluid. An example of a gas injection system is disclosed in U.S. Pat. No. 3,815,673 (Bruce et al) wherein an inert gas is compressed, transmitted down a separate conduit, and injected at various points along the lower end of the drilling riser. The patent also discloses a control system responsive to the hydrostatic head of the drilling fluid which controls the rate of gas injection in the riser in order to maintain the hydrostatic pressure at a desired level. Such control systems, however, have the disadvantage of inherent time lags which can result in instability. This is especially a problem in very deep water where there may be significant delays from the time a control signal is initiated to the time a change in gas rate can produce a change in the pressure at the lower end of the riser pipe. As a result, the gas lift systems disclosed in the prior art do not have predictable responses with changing conditions.

SUMMARY OF THE INVENTION

The apparatus and method of the present invention permit control of the pressure of drilling fluid during offshore drilling operations. In accordance with the present invention, drilling fluid is withdrawn from the upper portion of the drilling riser and returned to the surface through a separate flow line. Gas injected into the flow line substantially reduces the density of the drilling fluid and provides the lift necessary to bring the drilling fluid to the surface.

The apparatus of the present invention includes conventional offshore drilling components such as a riser pipe which extends from a floating drilling vessel or platform to a subsea wellhead and a drill string extending through the riser pipe and into the borehole penetrating subterranean formations. The apparatus also includes one or more flow lines in fluid communication with the upper portion of the riser pipe which extend up to the surface vessel or platform. Gas injection means such as gas supply conduits or injection lines are provided for introducing gas into the lower end of the flow lines at a rate sufficient to lift drilling fluid in the flow lines to the surface vessel. Control means such as throttle valves, pressure sensing devices, and valve controllers are used to control the rate of flow of the drilling fluid from the riser pipe to the flow lines such that the hydrostatic pressure of the column of drilling fluid remaining in the riser pipe and wellbore is maintained below the fracture pressure of the adjacent subterranean formations.

In accordance with the method of the present invention, drilling fluid is withdrawn from the riser pipe through the flow lines mentioned above. Gas is injected into the lower end of the flow lines. The injected gas mixes with the drilling fluid and lowers its density sufficiently to cause it to be positively displaced or "lifted" to the surface. In this manner, drilling fluid diverts from the upper portion of the riser pipe and returns to the surface through the adjacent flow lines. The rate of withdrawal of drilling fluid from the riser pipe is controlled so that the column of drilling fluid remaining in the riser pipe exerts a reduced hydrostatic pressure which does not exceed the fracture pressure of the formations penetrated by the drill string.

A method for controlling the withdrawal rate of the drilling fluid can include monitoring the hydrostatic pressure within the riser, transmitting a signal to the surface indicative of the pressure and controlling flow from the riser to the flow lines in response to the signal detected. As noted above, pressure sensors and valve control means can be used as part of the control mechanism. Since the control valves and gas injection points are near the upper rather than the lower portion of the riser, the time lags and unpredictable behavior inherent with other gas injection systems are not present here.

It will therefore be apparent that the present invention will permit a substantial reduction in the hydrostatic pressure of drilling fluid without sacrificing drilling rate. In addition, a control system can be employed which is more responsive and stable.

DESCRIPTION OF THE PREFERRED EMBODIMENT

Figure 1:
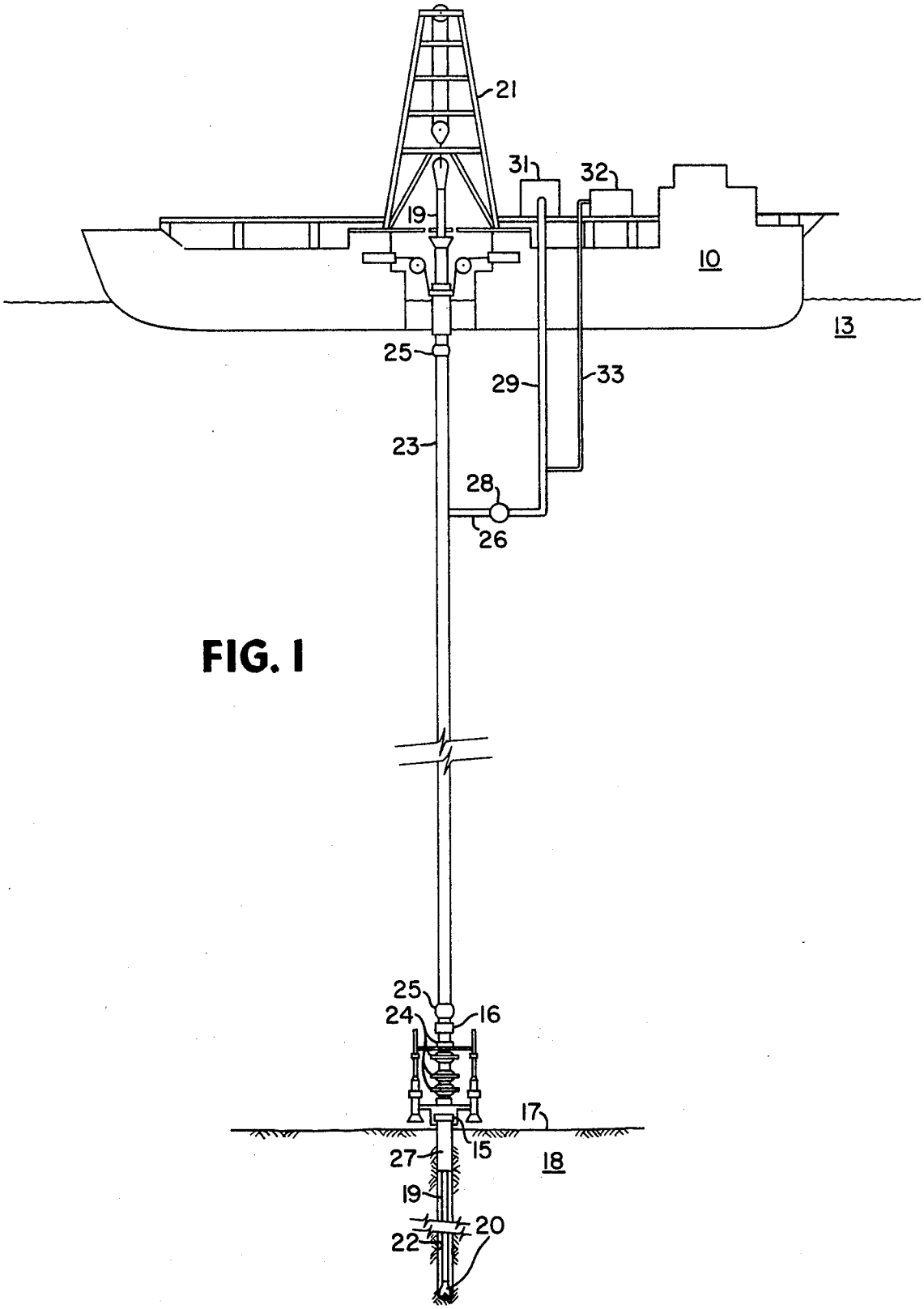
FIG. 1 is an elevation view, partially in section, of a floating drilling vessel provided with the apparatus of the present invention.

FIG. 1 shows a drilling vessel 10 floating on a body of water 13 and equipped with apparatus of the present invention to carry out the method of the present invention. A wellhead 15 is positioned on sea floor 17 which defines the upper surface or "mudline" of sedimentary formation 18. A drill string 19 and associated drill bit 20 are suspended from derrick 21 mounted on the vessel and extends to the bottom of wellbore 22. A length of structural casing pipe 27 extends from the wellhead to a depth of a few hundred feet into the bottom sediments above wellbore 22. Concentrically receiving drill string 19 is riser pipe 23 which is positioned between the upper end of blowout preventer stack 24 and vessel 10. Located at each end of riser pipe 23 are ball joints 25.

Positioned near the upper portions of riser pipe 23 is lateral outlet 26 which connects the riser pipe to flow line 29. Outlet 26 is provided with a throttle valve 28. Flow line 29 extends upwardly to separator 31 aboard vessel 10, thus providing fluid communication from riser pipe 23 through flow line 29 to surface vessel 10. Also aboard the drilling vessel is a compressor 32 for feeding pressurized gas into gas injection line 33 which extends downwardly from the drilling vessel and into the lower end of flow line 29.

In order to control the hydrostatic pressure of the drilling fluid within riser pipe 23, drilling fluids are returned to vessel 10 by means of flow line 29. As with normal offshore drilling operations, drilling fluids are circulated down through drill string 19 to drill bit 20. The drilling fluids exit the drill bit and return to riser pipe 23 through the annulus defined by drill string 19 and wellbore 22. A departure from normal drilling operations then occurs. Rather than return the drilling fluid and drilled cuttings through the riser pipe to the drilling vessel, the drilling fluid is maintained at a level which is somewhere between upper ball joint 25 and outlet 26. This fluid level is related to the desired hydrostatic pressure of the drilling fluid in the riser pipe which will not fracture sedimentary formation 18, yet which will maintain well control.

Drilling fluid is withdrawn from riser pipe 23 through lateral outlet 26 and is returned to vessel 10 through flow line 29. Throttle valve 28 which controls the rate of fluid withdrawal from the riser pipe, feeds the drilling fluid into flow line 29. Pressurized gas from compressor 32 is transported down gas injection line 33 and injected into the lower end of flow line 29. The injected gas mixes with the drilling fluid to form a lightened three phase fluid consisting of gas, drilling fluid and drill cuttings. The gasified fluid has a density substantially less than the original drilling fluid and has sufficient "lift" to flow to the surface.

Figure 2A:
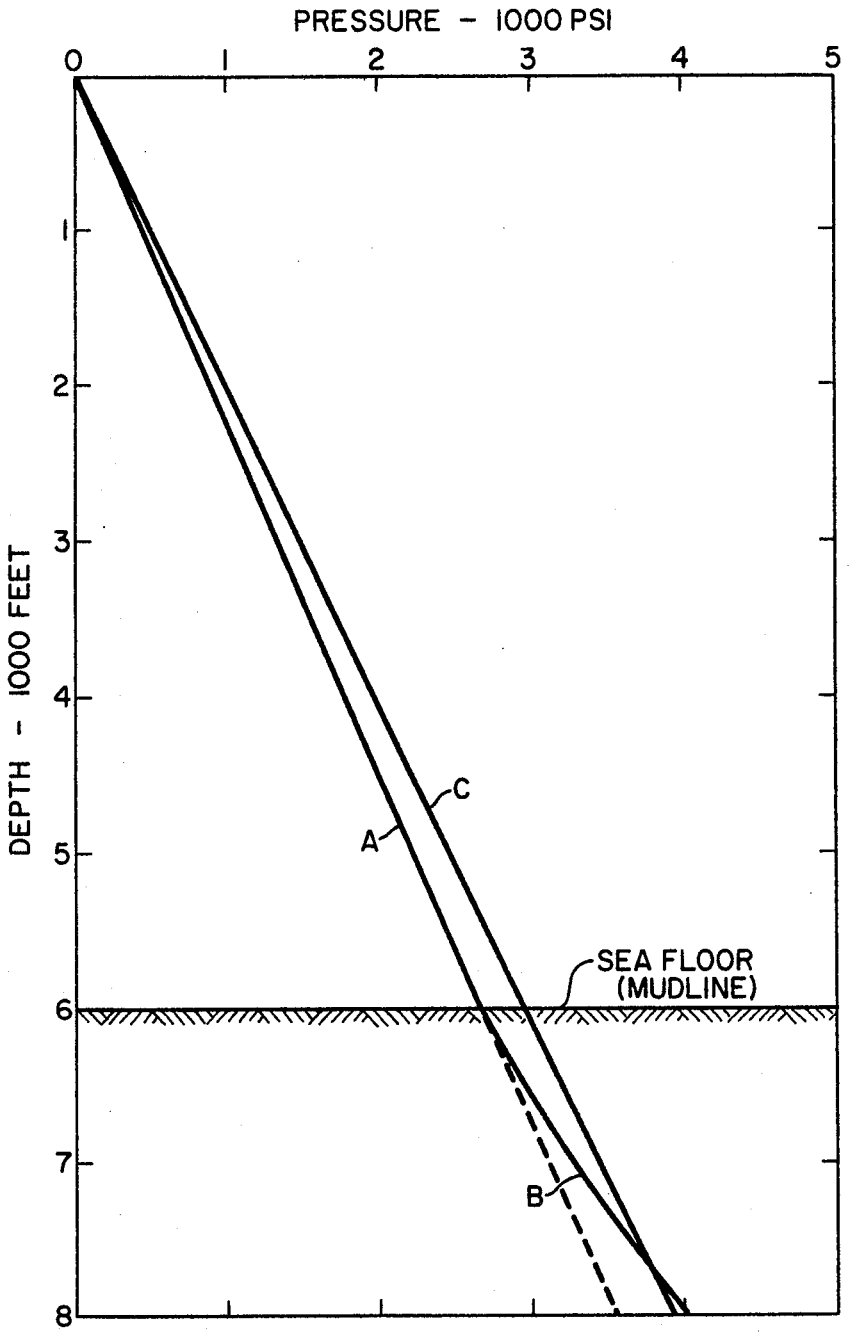
FIGS. 2(A) and 2(B) are plots of pressure versus depth which illustrate and compare the performance of the present invention with conventional drilling practices.
Figure 2B:
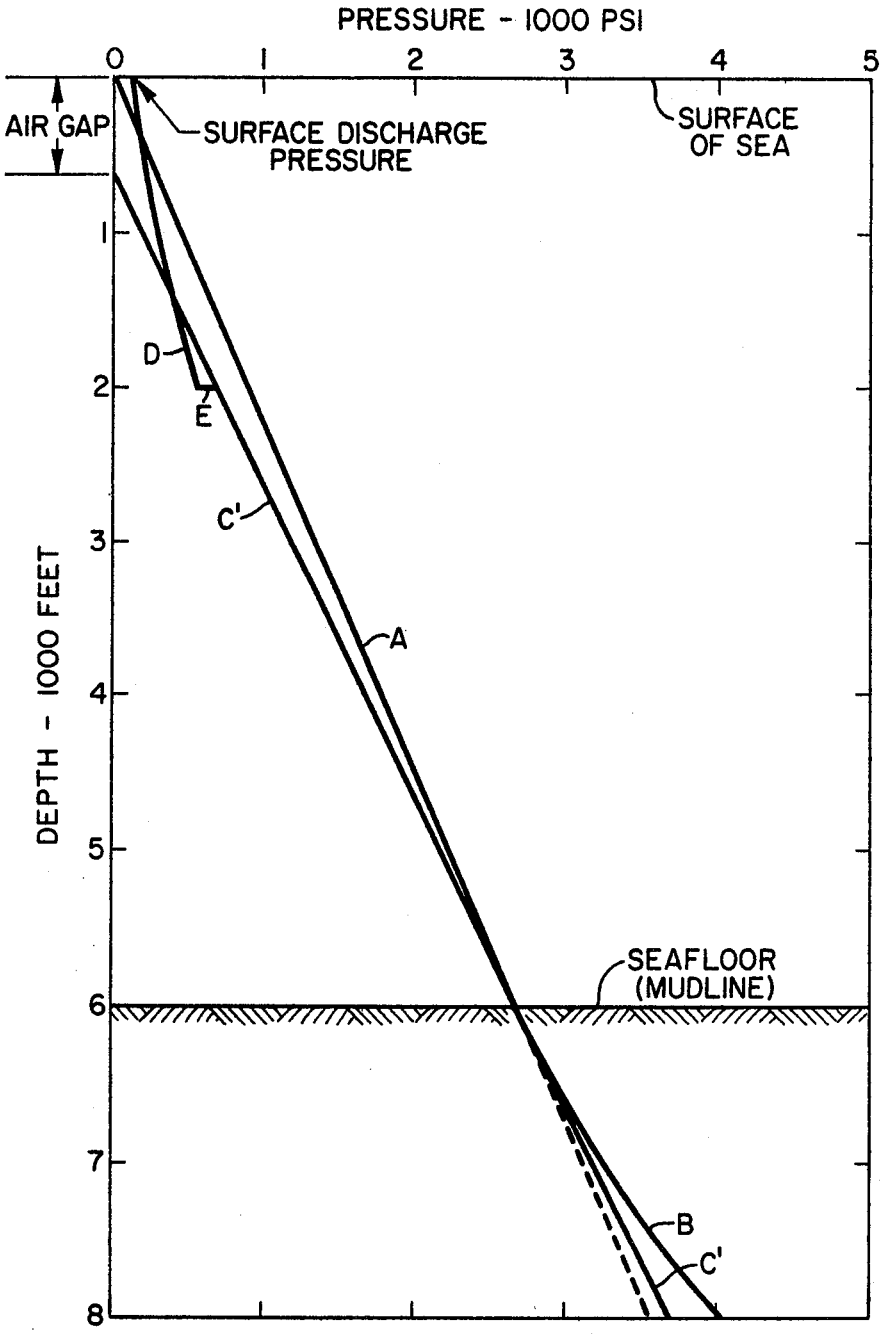

Th avoidance of formation fracture by the method and apparatus of the present invention is illustrated in FIGS. 2(A) and 2(B) which compare the pressure relationships involved in drilling an offshore well with and without the present invention. In FIG. 2(A), curve A relates hydrostatic pressure versus depth for seawater having a pressure gradient of 0.444 psi/ft (or about 8.5 pounds per gallon). This curve is shown extending from the sea surface to the sea floor or mudline which has arbitrarily been chosen to be 6000 feet below the surface. Extending below the sea floor is curve B which represents the fracture pressure of the subterranean formations beneath the sea. For normally consolidated sediments, the fracture pressure is approximately equal to the seawater pressure at the sea floor and increases with depth below the sea floor at a gradient greater than that of seawater (the seawater gradient being shown by the dotted line extension of curve A).

Corresponding to curves A and B is curve C which relates hydrostatic pressure versus depth for drilling mud inside a riser pipe and wellbore. The curve is for a typical drilling mud having a density of 9.5 pounds per gallon (including drill cuttings) thereby giving it a pressure gradient of 0.494 psi/ft. It can be readily seen that until a total depth of about 7700 feet (1700 feet below the sea floor) the hydrostatic wellbore pressure of the drilling mud exceeds the fracture pressure of the formation. The point of intersection of curves B and C represents the point below which the formation can be safely drilled with the 9.5 ppg mud. However, except for the first few hundred feet below the mudline which are protected by structural casing, the entire interval from beneath the structural casing to a depth of 1700 feet below the sea floor would be in danger of formation fracture and lost returns and could not be safely drilled with conventional drilling practices using 9.5 ppg mud.

FIG. 2(B) shows how the present invention permits safe drilling through upper level sediments without the danger of formation fracture. As before, curves A and B respectively represent seawater pressure and fracture pressure versus depth. Curve C'represents the hydrostatic pressure of the drilling mud in the riser pipe and wellbore. Note, however, that since drilling fluid is being withdrawn from the riser by the gas lift system of the present invention there exists an air gap at the top of the riser pipe. An air gap of about 600 feet is shown in FIG. 2B for curve C'. This air gap offsets the riser and wellbore pressure sufficiently so that at the depth of the sea floor the mud pressure is approximately equal to that of the surrounding seawater. Consequently, the pressure of the mud within the wellbore will always be less than the fracture pressure of the formation.

In order to maintain the air gap at the proper depth under circulating conditions it is necessary to divert the drilling mud from the riser at a point somewhat below the depth of the largest air gap that may be required. Curve D represents the pressure profile for the drilling mud as it is diverted from the riser pipe at a depth of about 2000 feet and gas lifted to the surface where it is discharged to a separator at some positive pressure. The dog leg at the lower end of Curve D indicated by letter E represents the pressure drop incurred by the drilling mud as its flows through the throttling valve.

Figure 3:
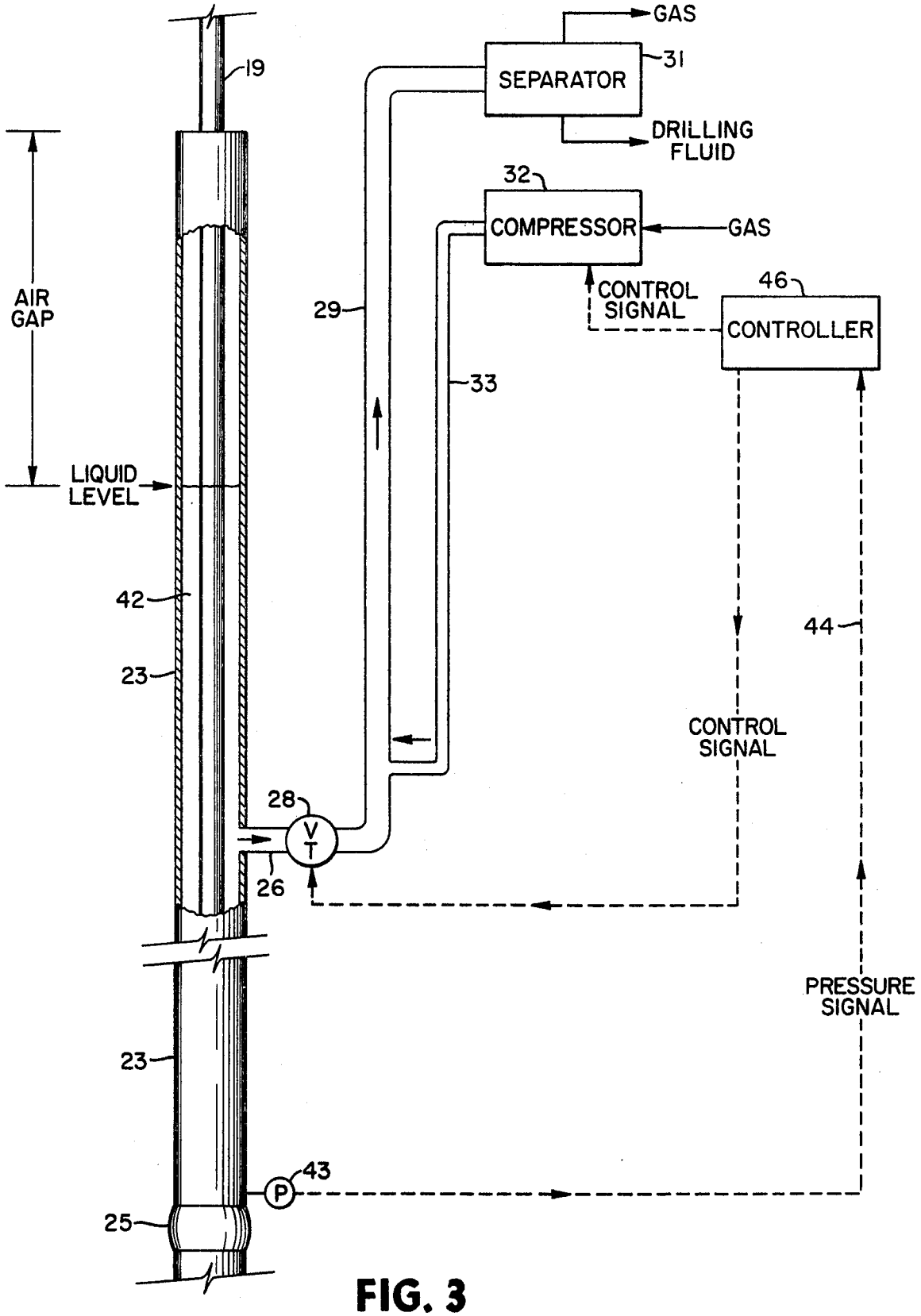
FIG. 3 is a schematic diagram, partially in section, of the apparatus of the present invention including a control system for regulating the hydrostatic pressure of the drilling fluid in a marine riser.

FIG. 3 schematically depicts in more detail the operation of the gas left system of the present invention. Gas such as air or an inert gas is fed into compressor 32. If it is desirable to minimize the chance of corroding valves or tubulars coming in contact with the gas, an inert gas would be preferred. A frequently used inert gas is the exhaust gas generated by the internal combustion engines aboard the drill ship which provide the power to run the equipment associated with drilling operations. Normally, the gas undergoes several treatment stages to remove undesirable components before being compressed and sent into injection line 33.

At the surface, gasified drilling fluid returning through flow line 29 is separated into its gas and drilling fluid constituents by separator 31. The separator can be a part of or be augmented by a conventional mud treatment system. If preferred, both drilling fluid and gas can be recycled into the system once separated.

Control over the liquid level of drilling fluid 42 shown in the partial cross-sectional view of riser pipe 23 in FIG. 3 can be maintained by standard control techniques. Pressure sensor 43, positioned at the lower end of riser pipe 23 above lower ball joint 25, detects the pressure of the drilling fluid in the riser and transmits a signal to the surface by means of electrical conductor 44 which extends from sensor 43 to the drilling vessel. Sensor 43 may, for example, be a differential pressure transducer which generates an electrical signal proportional to the difference between the pressure within the riser pipe and the surrounding sea water. The sensor can be located along the lower end of the riser pipe as shown or it can be positioned on the BOP stack. Conductor 44 transmits the differential pressure signal to valve controller 46 which returns a control signal, responsive to the pressure signal, to actuate throttle valve 28. Throttle valve 28 would be moved to a more opened or closed position so as to provide the change of the liquid level in the drilling riser necessary to maintain adequate hydrostatic head and well control. In conjunction with control of throttle valve 28, controller 46 can be used to control the output of the gas from compressor 32. In this manner the rate of gas injection can be modified to provide adequate lift for existing circulating conditions. Numerous other control systems, well known in the art, can be employed to control the liquid level in the drilling riser.

As previously discussed with regard to FIG. 2(A) and as shown in FIG. 3, there exists an air gap in riser pipe 23 (above the liquid level of drilling fluid 42) which is indicative of the extent to which the hydrostatic head of the drilling fluid has been reduced by the method and apparatus of the present invention. Computation of the air gap necessary to maintain the seafloor level pressure within riser pipe 23 equal to surrounding sea pressure is straightforward. For example, assume the following:

Water Depth = 6000 ft

Sea Water Density
= 8.55 pounds per gallon
= 0.444 psi/ft (pressure gradient)

Drilling Fluid Density
= 9.5 pounds per gallon
= 0.494 psi/ft (pressure gradient)

At a depth of 6000 feet, seawater will exert an overburden pressure of (6000 ft) × (0.444 psi/ft) = 2664 psi. To equalize pressure inside and outside the riser at 6000 feet, the pressure exerted by a column of drilling fluid must, therefore, be equal to 2664 psi and would be governed by the equation:

$$0.494\ D_F = 2664$$

where $D_F$ = Liquid Level of Drilling Fluid

Solving for $D_F$, $D_F$ = 5393 feet.

Thus the desired column of drilling fluid would be 5393 feet long, necessitating an air gap within the drilling riser of 607 feet.

It should be apparent from the foregoing that the apparatus and method of the present invention offer significant advantages over hydrostatic pressure control systems for marine risers previously known to the art. It will be appreciated that while the present invention has been primarily described with regard to the foregoing embodiments, it should be understood that several variations and modifications may be made in the embodiments described herein without departing from the broad inventive concept disclosed herein.

I claim:

1. In an apparatus for drilling a well through subterranean formations beneath a body of water from the surface of said body of water, said apparatus having a riser pipe which extends from the surface to a subsea wellhead and a drill string which passes through said riser pipe and into a borehole under the body of water, the improvement comprising:

a flow line in fluid communication with the upper portion of said riser pipe and extending up to the surface;

means for injecting gas into the lower end of said flow line at a rate sufficient to lift drilling fluid in said flow line to the surface;

means for detecting the pressure within said riser pipe and for transmitting a signal indicative of said pressure to the surface; and valve control means responsive to the pressure signal from said sensing means which regulate the rate of flow of the drilling fluid from said riser pipe into said flow line such that the pressure of the drilling fluid in said borehole does not exceed the fracture pressure of said subterranean formations.

2. The apparatus of claim 1 wherein said gas injection means is a gas supply conduit which extends down from the surface to said flow line.

3. The apparatus of claim 2 wherein said injected gas is an inert gas.

4. The apparatus of claim 1 wheren said valve control means includes valve means in fluid communication with said riser pipe which regulates the flow of drilling fluid from said riser pipe to said flow line.

5. The apparatus of claim 4 wherein said valve means is a throttle valve.

6. In a method of drilling a well through subterranean formations beneath a body of water from the surface of said body of water wherein a riser pipe extends from the surface to a subsea wellhead and wherein a drill string passes through said riser pipe and into a borehole under the body of water, the improvement comprising:

withdrawing drilling fluid from said riser pipe through a flow line in fluid communication with said riser pipe;

injecting gas into said flow line at a rate sufficient to lift drilling fluid in said flow line to said surface vessel;

monitoring the pressure within said riser pipe;

transmitting a surface detectable signal indicative of said pressure; and controlling the rate of withdrawal of the drilling fluid from said riser pipe in response to said surface detectable signal such that the pressure within said borehole does not exceed the fracture pressure of said formations.

* * * * *